US006104743A

United States Patent [19]

Nomura et al.

[11] Patent Number: 6,104,743

[45] Date of Patent: Aug. 15, 2000

[54] ELECTRIC ARC FURNACE COOLING APPARATUS

[75] Inventors: Tamotsu Nomura, Chita-gun; Nagatoshi Hayakawa, Nagoya; Yoshinobu Masuya, Kariya, all of Japan

[73] Assignee: Daido Tokushuko Kabushiki Kaisha, Japan

[21] Appl. No.: 09/313,207

[22] Filed: May 18, 1999

[30] Foreign Application Priority Data

May 19, 1998 [JP] Japan ..... 10-155255

[51] Int. Cl.[7] ..... F27D 1/12

[52] U.S. Cl. ..... 373/76; 373/74; 373/84

[58] Field of Search ..... 373/73–76, 71–72, 373/84

[56] References Cited

U.S. PATENT DOCUMENTS

| | | | |
|---|---|---|---|
| 3,214,153 | 10/1965 | Hauff et al. | 373/76 |
| 3,723,632 | 3/1973 | Beizerov | 373/74 |
| 3,735,010 | 5/1973 | Turpin | 373/76 |
| 4,637,034 | 1/1987 | Grageda | 373/76 |
| 5,561,685 | 10/1996 | Lehr et al. | 373/76 |

FOREIGN PATENT DOCUMENTS

| | | |
|---|---|---|
| 0 116 696 | 8/1984 | European Pat. Off. . |
| 2 552 865 | 4/1985 | France . |

*Primary Examiner*—Tu Ba Hoang
*Attorney, Agent, or Firm*—Bacon & Thomas PLLC

[57] ABSTRACT

In an electric arc furnace cooling apparatus in which cooling water is made to flow into a plurality of water-cooled panels provided around side walls of a furnace body of an electric arc furnace to thereby cool the furnace body, a water collecting trough is provided in a platform mounted in the electric arc furnace to thereby collect waste water discharged from the water-cooled panels, and a water receiving trough is provided outside the platform to thereby receive waste water discharged from the water collecting trough.

12 Claims, 3 Drawing Sheets

ELECTRIC ARC FURNACE COOLING APPARATUS

BACKGROUND OF THE INVENTION

1. Field of the Invention

The present invention relates to an electric arc furnace cooling apparatus. Various electric arc furnaces such as arc furnaces are used for melting or smelting metal materials, or the like. Generally, such an electric arc furnace has a furnace body and a furnace roof attached to the furnace body to be openable/closable. Electrodes are inserted into the furnace body through the furnace roof to be movable up and down. A platform is attached in the furnace to be tiltable body together with the furnace body when steel or slags are taken out of the furnace body. The present invention relates to improvement of an apparatus for cooling a furnace body and/or a furnace roof of such an electric arc furnace.

2. Description of the Related Art

As for such an apparatus for cooling a furnace body of an electric arc furnace, there has been used an apparatus in which a plurality of water-cooled panels are provided around side walls of the furnace body to thereby make cooling water flow into these water-cooled panels. In such an apparatus, generally, drainage hoses are attached to drainage ports of the respective water-cooled panels in order to drain waste water from the plural water-cooled panels after the water has cooled the furnace body. The drainage hoses are led out from the inside of a platform to the outside of the platform. However, in such an apparatus, the plural drainage hoses must be led out from the inside of the platform to the outside of the platform with sufficient bending lest the drainage hoses should hinder the tilting of the furnace body. Consequently, there are many problems encountered in that the structure of the apparatus is therefore complicated; that the operation and maintenance/management are burdensome; that a large-sized water supply pump is required for overcoming the pressure loss when water passes through the drainage hoses; and the like.

As described above, in the conventional apparatus for cooling a furnace body of an electric arc furnace, the structure is complicated, the operation and management are also burdensome, and a large-sized water supply pump or the like is required.

SUMMARY OF THE INVENTION

It is an object of the present invention to provide an electric arc furnace cooling apparatus in which the structure thereof can be simplified, the operation and the maintenance/management can be performed easily, and which requires no large-sized water supply pump or the like.

An electric arc furnace cooling apparatus according to the present invention comprises a plurality of water-cooled panels, a water collecting trough, and a water receiving trough. The plurality of water-cooled panels is provided around side walls of a furnace body of an electric arc furnace. Cooling water is made to flow into said plurality of water-cooled panels to cool said furnace body. The water collecting trough is provided in a platform mounted in the electric arc furnace to collect waste water discharged from said water-cooled panels. The water receiving trough is provided outside said platform to receive waste water discharged from said water collecting trough.

DETAILED DESCRIPTION OF THE INVENTION

Figure 1:
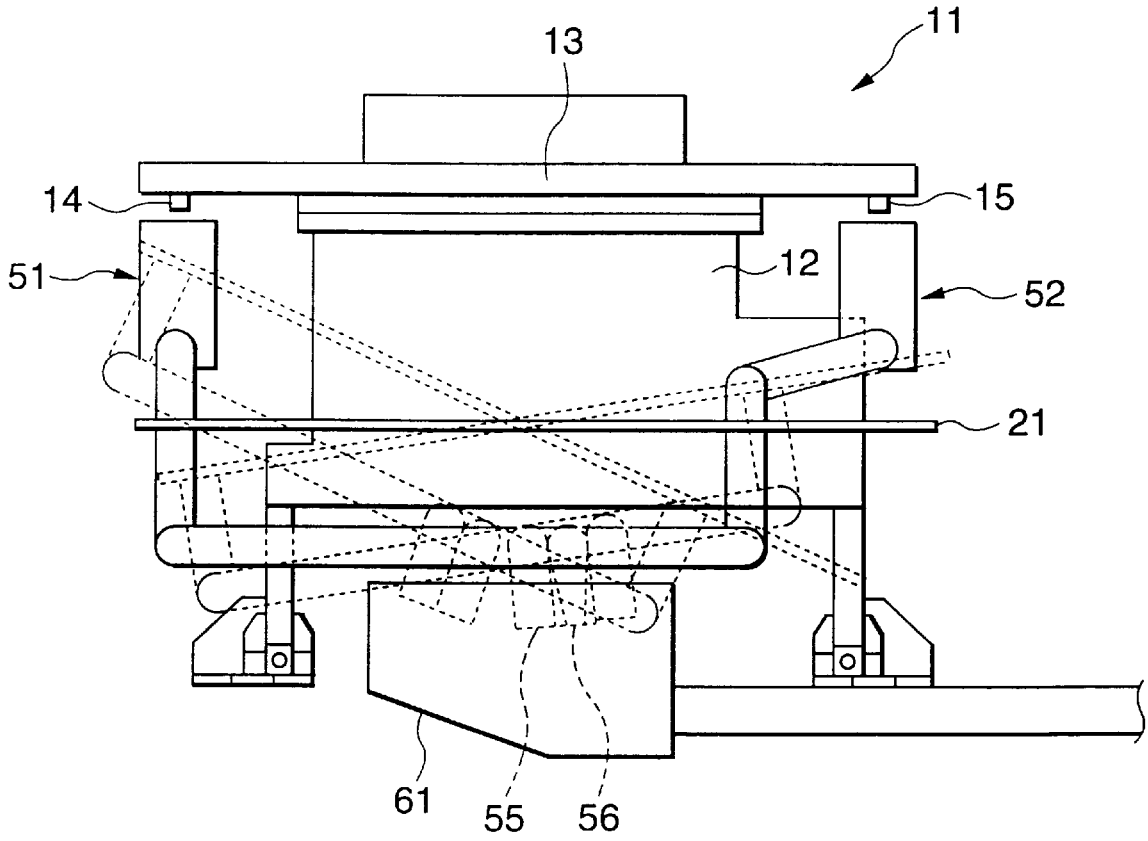
FIG. 1 is a front view illustrating an embodiment of a cooling apparatus according to the present invention.

Detailed description of the invention will be described as follows.

According to the present invention, provided is an electric arc furnace cooling apparatus in which cooling water is made to flow into a plurality of water-cooled panels provided around side walls of a furnace body of an electric arc furnace to thereby cool the furnace body. A water collecting trough is provided in a platform mounted in the electric arc furnace to thereby collect waste water discharged from the water-cooled panels. A water receiving trough is provided outside the platform to thereby receive waste water discharged from the water collecting trough.

Generally, the electric arc furnace to which the present invention is applied has a furnace body and a furnace roof attached to the furnace body so that the furnace is made openable/closable. Electrodes are inserted into the furnace body through the furnace roof so as to be movable up and down, and a platform is mounted in the furnace body so as to be tiltable together with the furnace body when steel or slags are took out of the furnace body. In addition, a plurality of water-cooled panels are provided around side walls of the furnace body, and cooling water is poured into these hollow panel to cool the furnace body. To cool the furnace roof at the same time, the furnace roof is provided with a water-cooled structure, and cooling water is poured into such a water-cooled furnace roof to cool the furnace roof.

In the cooling apparatus according to the present invention, a water collecting trough is provided inside a platform mounted in the electric arc furnace to thereby collect the waste water discharged from the plural water-cooled panels provided around the side walls of the furnace body of the electric arc furnace after the water cools the furnace body, and a water receiving trough is provided outside the platform to thereby receive the waste water discharged from the water collecting trough. The water collecting trough is supported on the furnace body and/or the platform, while the water receiving trough is disposed outside the platform. The water collecting trough tilts together with the furnace body and the platform, and hence its drainage hole also tilts in the same way. Accordingly, the upper portion of the water receiving trough is opened extending over a range of tilting of the drainage hole of the water collecting trough and facing the drainage hole just above. In the case where the furnace roof is cooled at the same time, the upper portion of the water collecting trough is opened facing the drainage hole of the water-cooled furnace roof just above so that waste water discharged from the water-cooled furnace roof can be collected also in the water collecting trough.

It is preferable that two systems of water collecting troughs are provided on the opposite sides of the furnace body respectively in each of two directions divided with respect to a furnace core. In addition, it is preferable that drainage holes of the water collecting troughs are led in an area lower than the furnace bottom so that the waste water discharged from the water-cooled panels provided around the side walls of the furnace body after the water cools the furnace body and the waste water discharged from the water-cooled furnace roof after the water cools the furnace roof can flow down within the water collecting troughs smoothly by its own gravity. It is therefore preferable that water receiving troughs for receiving the waste water discharged from these drainage holes of the water collecting troughs are also disposed in an area lower than the furnace bottom.

In the present invention, the waste water discharged from the plural hollow panel provided around the side walls of the furnace body after the water cools the furnace body and the waste water discharged from the water-cooled furnace roof after the water cools the furnace roof is collected in the water collecting troughs supported on the furnace body and/or the platform. The water collected thus is allowed to flow down within the water collecting troughs by its own gravity. The collected water is then received by and discharged out of the water receiving troughs disposed outside the platform. Unlike the apparatus in the background art, it is not necessary to lead a plurality of drainage hoses with sufficient bending from the inside of the platform to the outside of the platform. Therefore, according to the present invention, it is possible to make the structure simple and make the operation and the maintenance/management easy, and it is not necessary to provide a large-sized water supply pump or the like.

Preferred embodiments according to the present invention will be described as follows referring to the accompanying drawings.

Figure 2:
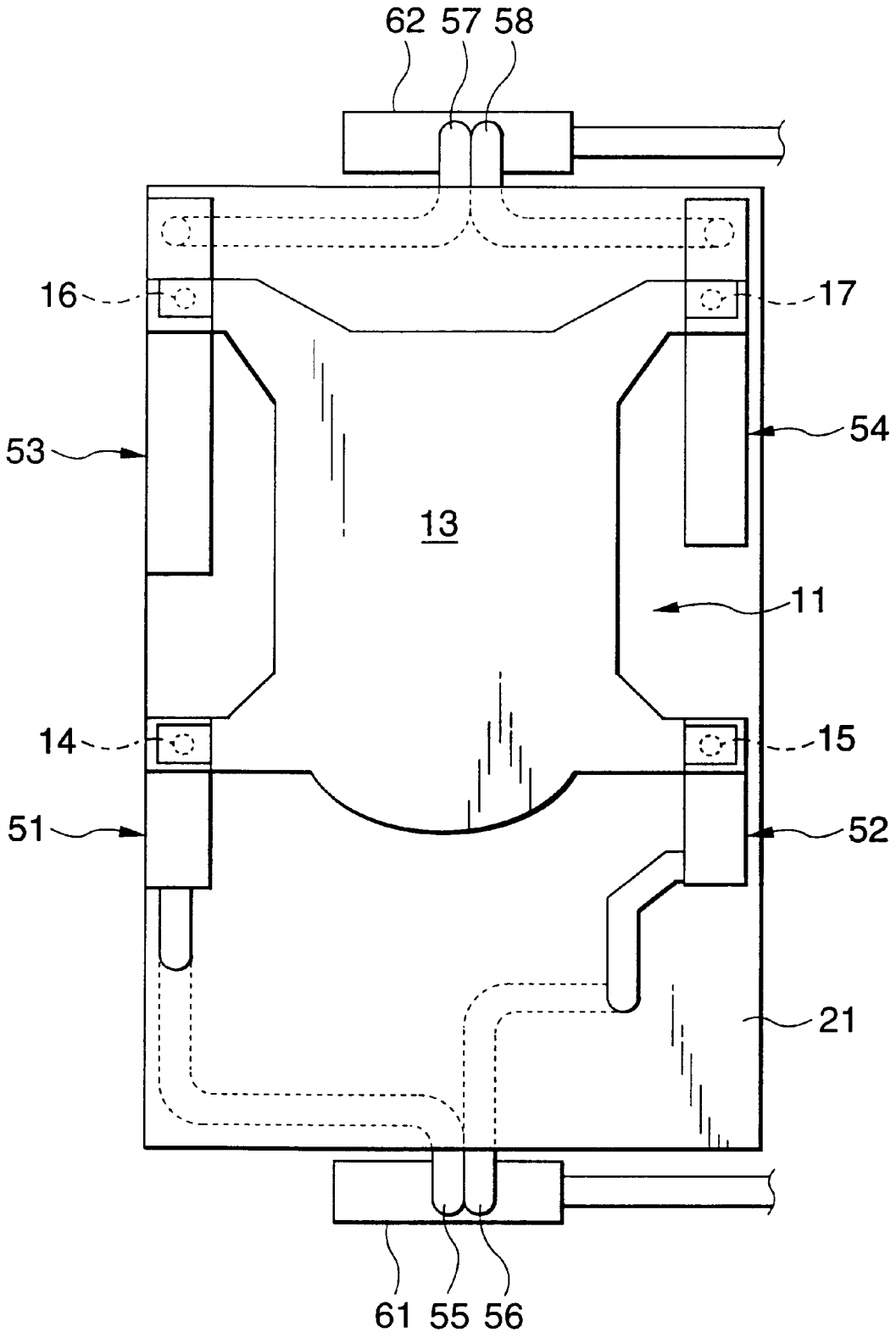
FIG. 2 is a plan view illustrating the cooling apparatus in FIG. 1.
Figure 3:
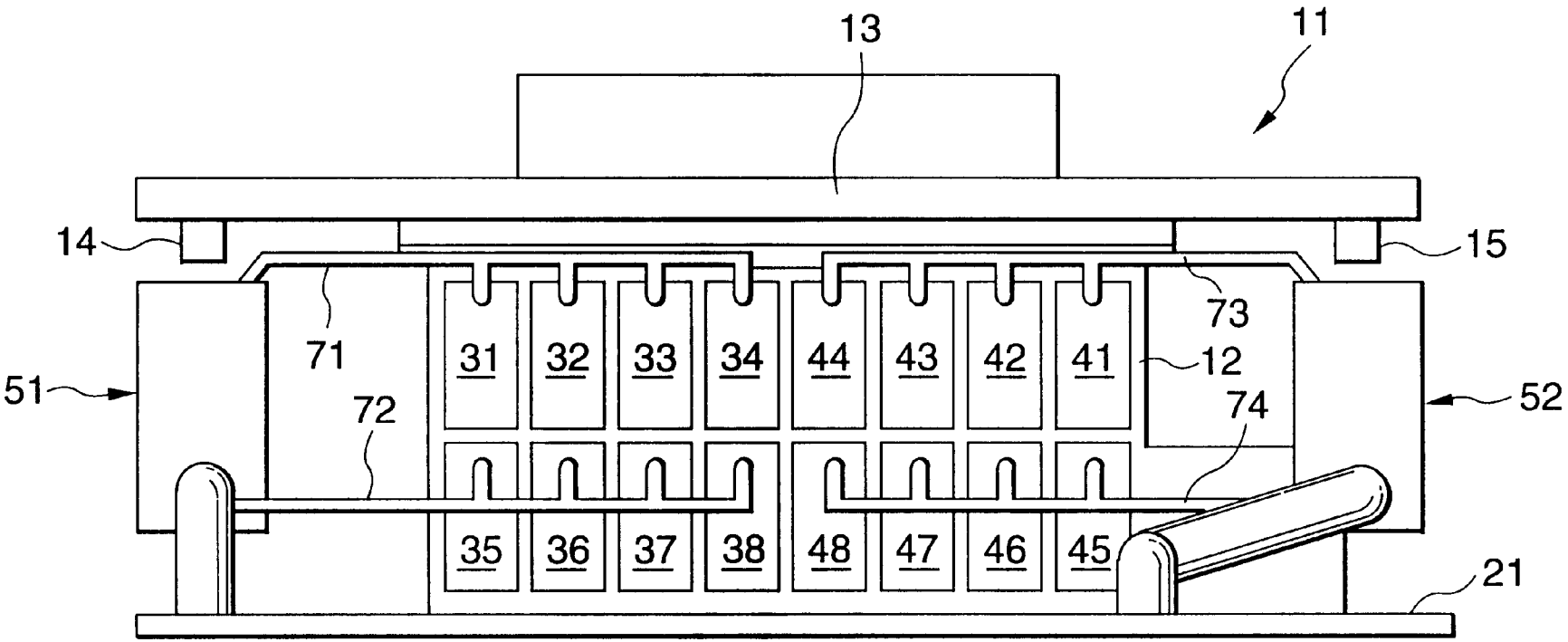
FIG. 3 is an enlarged partial view of FIG. 1.

FIG. 1 is a front view illustrating one embodiment of a cooling apparatus according to the present invention. FIG. 2 is a plan view illustrating the cooling apparatus of FIG. 1. FIG. 3 is an enlarged partial view of FIG. 1. These drawings show an apparatus for an arc furnace. An arc furnace 11 has a furnace body 12 and a furnace roof 13 attached to the furnace body 12 so as to be openable and closable. Not-shown electrodes are inserted into the furnace body 12 through the furnace roof 13 so as to be movable up and down. The furnace body 12 is provided with a platform 21 so as to be tiltable together with the platform 21 in the left/right direction in the drawings, when steel or slags are took out of the furnace body 12. In addition, a plurality of water-cooled panels 31 to 38, 41 to 48, . . . are provided around side walls of the furnace body 12 so that cooling water is poured into these hollow panel to cool the furnace body 12. In addition, the furnace roof 13 is formed into a water-cooled structure so that cooling water is poured into the hollow portion to cool the furnace roof 13. The manner how to supply the cooling water to the plural water-cooled panels 31 to 38, 41 to 48, . . . , and the manner how to supply the cooling water to the hollow portion of the furnace roof 13 are themselves the same as those in the apparatus in the conventional art. Accordingly, the detailed description about them is omitted here.

Water collecting troughs 51 to 54 are provided in the platform 21 to thereby collect the waste water discharged from the plural water-cooled panels 31 to 38, 41 to 48, . . . provided around the side walls of the furnace body 12 after the water cools the furnace body 12 and the waste water discharged from the furnace roof 13 after the water cools the furnace roof 13 are provided in the platform 21. On the other hand, water receiving troughs 61 and 62 are provided outside the platform 21 to thereby receive the waste water discharged from these water collecting troughs 51 to 54. The water collecting troughs 51 to 54 are supported on the furnace body 12 and the platform 21, while the water receiving troughs 61 and 62 are disposed outside the platform 21. In the case illustrated in the drawings, the furnace body 12 and the platform 21 tilt right when steel is taken out of the furnace body 12, while the furnace body 12 and the platform 21 tilt left when slags are taken out of the furnace body 12. At that time, the water collecting troughs 51 to 54 tilt together with the furnace body 12 and the platform 21, and hence drainage holes 55 to 58 of the water collecting troughs 51 to 54 tilt in the same manner. Therefore, the upper portions of the water receiving troughs 61 and 62 extend over the tilting range of the drainage holes illustrated by the broken lines in FIG. 1, and are opened facing the drainage holes just above as if the water receiving troughs 61 and 62 accommodate those drainage holes.

The water collecting troughs 51 to 54 are divided, with respect to a furnace core, into two directions perpendicular to the tilting direction of the furnace body 12 lest the water collecting troughs 51 to 54 should hinder the furnace body 12 when the furnace body 12 is tilted to take out steel or slags. That is, two systems of the water collecting troughs 51 and 52 are provided respectively on the opposite sides of the furnace body 12 in one of the above-mentioned two divisional directions, while the two systems of the water collecting troughs 53 and 54 are provided respectively on the opposite sides of the furnace body 12 in the other divisional direction. In addition, in the case illustrated in the drawings, water-cooled panels 31 to 38 and 41 to 48, which are twelve in number in total, are provided around the front side wall of the furnace body 12. Drainage pipes are attached to drainage holes of the water-cooled panels 31 to 34 respectively. These drainage pipes are joined to a header 71 together, and the header 71 is connected to the water collecting trough 51. In the same manner, drainage pipes are attached to drainage holes of the other water-cooled panels 35 to 38 and 41 to 48. These drainage pipes are joined to headers 72 to 74 together, and the headers 72 to 74 are connected to the water collecting troughs 51 and 52. In such a manner, the waste water discharged from the water-cooled panels 31 to 38 and 41 to 48 after the water cool the furnace body is collected in the water collecting troughs 51 and 52 through the corresponding drainage pipe sand headers 71 to 74. Though not illustrated in the drawings, similar water-cooled panels, drainage pipes and headers are provided around the other side wall, so that the waste water discharged from the water-cooled panels after the water cool the furnace body is collected to the water collecting troughs 51 to 54 through the drainage pipes and the headers. On the other hand, the drainage holes 14 to 17, which are four in total, are provided in the furnace roof 13. The drainage hole 14 faces the opened upper portion of the water collecting trough 51 just under, while the drainage holes 15 to 17 also face the opened upper portions of the water collecting troughs 52 to 54 just under in the same manner. In such a manner, the waste water discharged from the furnace roof 13 is allowed to flow down in its own gravity so as to be collected in the water collecting troughs 51 to 54 through the drainage holes 14 to 17 provided in the four corners.

The drainage holes 55 to 58 of the water collecting troughs 51 to 54 are led out into an area lower than the furnace bottom so that the waste water discharged from the water-cooled panels 31 to 38, 41 to 48, . . . provided around the side walls of the furnace body 12 or the waste water discharged from the furnace roof 13 can flow down by its own gravity smoothly through the water collecting troughs 51 to 54. Therefore, the water receiving troughs 61 and 62 for receiving the waste water discharged from these drainage holes 55 to 58 are also disposed in an area lower than the furnace bottom. In the case illustrated in the drawings, the waste water discharged from the water-cooled panels 31 to 38, 41 to 48, . . . provided around the side walls of the furnace body 12 after the water cools the furnace body 12 and the waste water discharged from the furnace roof 13 after the water cools the furnace roof 13 is collected in the water collecting troughs 51 to 54 supported on the furnace body 12 and the platform 21. Accordingly, the collected water is allowed to flow down by its own gravity through the water collecting troughs 51 to 54, and then received by and discharged out of the water receiving troughs 61 and 62 disposed outside the platform 21.

As has been made apparent, the present invention described above, has effects that it is possible to make the structure simple and make the operation and the maintenance/management easy, and it is not necessary to provide a large-sized water supply pump or the like.

What is claimed is:

1. An electric arc furnace cooling apparatus comprising:

a plurality of water-cooled panels provided around side walls of a furnace body of an electric arc furnace, cooling water being made to flow into said plurality of water-cooled panels to cool said furnace body;

at least one water collecting trough provided in a platform mounted to said furnace body, said water collecting trough being arranged to collect waste water discharged from said water-cooled panels; and a water receiving trough provided outside said platform, said water receiving trough being arranged to receive waste water discharged from said water collecting trough.

2. The electric arc furnace cooling apparatus according to claim 1, wherein cooling water is also made to flow into a water-cooled furnace roof to cool said water-cooled furnace roof and said water collecting trough collects waste water discharged from said water-cooled panels and waste water discharged from said water-cooled furnace roof.

3. The electric arc furnace cooling apparatus according to claim 1, wherein two systems each including at least one water collecting trough are provided on each of opposite sides of said furnace body in each of two directions divided with respect to a furnace core.

4. The electric arc furnace cooling apparatus according to claim 1, wherein said water collecting trough is supported on at least one of said furnace body and said platform.

5. The electric arc furnace cooling apparatus according to claim 1, wherein a drainage hole of said collecting trough is provided in an area lower than a bottom face of said platform.

6. The electric arc furnace cooling apparatus according to claim 1, wherein said water collecting trough is disposed in an area lower than a bottom face of said platform.

7. A cooling apparatus for an electric arc furnace having a furnace body, side walls and a platform attached to the furnace body, the furnace body and the platform being tiltable together, the cooling apparatus comprising:

a plurality of water-cooled panels provided around the side walls of the furnace body, cooling water being made to flow into the water-cooled panels to cool the furnace body;

at least one water collecting trough provided in the platform and supported so as to tilt with the furnace body and the platform, the water collecting trough being arranged to collect waste water discharged from the water-cooled panels; and at least one water receiving trough provided outside the platform, the water receiving trough being arranged to receive waste water discharged from the water collecting trough.

8. The cooling apparatus according to claim 7, further comprising:

a water-cooled furnace roof provided on the furnace body, cooling water also being made to flow into the water-cooled roof;

wherein the water collecting trough is also arranged to collect waste water discharged from the water-cooled roof.

9. The cooling apparatus according to claim 7, wherein a first system including at least one water collecting trough is provided on one side of the furnace body and a second system including at least one water collecting trough is provided on an opposite side of the furnace body such that the first and second systems are divided with respect to a core of the furnace.

10. The cooling apparatus according to claim 7, wherein the water collecting trough is supported on at least one of the furnace body and the platform.

11. The cooling apparatus according to claim 7, wherein a drainage hole of the collecting trough is provided in an area lower than a bottom face of the platform.

12. The cooling apparatus according to claim 7, wherein the water collecting trough is disposed in an area lower than a bottom face of the platform.

* * * * *